United States Patent [19]

Matsui

[11] Patent Number: 4,627,753

[45] Date of Patent: Dec. 9, 1986

[54] DAISY-WHEEL TYPE PRINTING SYSTEM WITH MULTIPLE FUNCTIONS

[75] Inventor: Hirotoshi Matsui, Nara, Japan

[73] Assignee: Sharp Kabushiki Kaisha, Osaka, Japan

[21] Appl. No.: 694,676

[22] Filed: Jan. 24, 1985

[30] Foreign Application Priority Data

Jan. 27, 1984 [JP] Japan ..... 59-10447[U]
Jan. 27, 1984 [JP] Japan ..... 59-10448[U]

[51] Int. Cl.[4] ..... B41J 1/46

[52] U.S. Cl. ..... 400/174; 400/144.2; 400/175

[58] Field of Search ..... 400/16–22, 400/144, 144.1, 144.2, 144.4, 175, 174; 401/34, 35

[56] References Cited

U.S. PATENT DOCUMENTS

| | | | |
|---|---|---|---|
| 722,160 | 3/1903 | Steiger | 401/34 |
| 2,446,360 | 8/1948 | Clark | 400/18 |
| 3,935,937 | 2/1976 | Tramposch | 400/174 |
| 4,164,744 | 8/1979 | Freude | 400/470 X |

FOREIGN PATENT DOCUMENTS

| | | | |
|---|---|---|---|
| 0089966 | 6/1982 | Japan | 400/18 |

*Primary Examiner*—Edgar S. Burr
*Assistant Examiner*—John A. Weresh
*Attorney, Agent, or Firm*—Birch, Stewart, Kolasch & Birch

[57] ABSTRACT

A printer is provided with carriage having a daisy print wheel supporting type elements at the external circumferential edges of respective spokes that make up the wheel. The printer sequentially performs a printing operation by causing its carriage to move in the direction of a printing row and a hammer to strike the designated type element held by an associated print wheel spoke after rotating the designated type element into the printing position. The daisy print wheel includes a number of spokes each mounting a type element at its external circumferential edge. At least one of these spokes is provided with a pen at the position corresponding to that of the type element held by the remaining spokes, and as a result, by selecting the pen from the type element supported in the remaining spokes, either a picture, diagram, or a graph can be optionally drawn, thus effectively realizing a multifunctional printer.

12 Claims, 7 Drawing Figures

DAISY-WHEEL TYPE PRINTING SYSTEM WITH MULTIPLE FUNCTIONS

BACKGROUND OF THE INVENTION

The present invention relates to a daisy-wheel printer including a daisy print wheel (having types at the external circumferential edges of individual spokes making up a daisy wheel) provided its carriage. The printer of the present invention sequentially performs a printing operation by controlling the movement of the carriage in the direction of the printing row and by the rotation of the designated type element of the print wheel to the printing position. Such a daisy-wheel type printer is well known by the prior art, for example as disclosed by the Japanese Patent Publication No. 8388 of 1981 and the Japanese Patent Laid-Open Document No. 25931 of 1976, and actually, is already been widely used.

The daisy-wheel type print is provided with the printer wheel 1 as shown in FIG. 1. It has a plurality of spokes 2,2 . . . , each having the identical shape and externally extending from the center hub 3. Each spoke 2 is provided with a type element 4 at the external circumferential position. Type elements normally include capital and small alphabetical characters, numerals, and symbols. As shown in FIG. 2, the printer wheel 1 is coupled to the shaft of the drive motor 5 mounted on the carriage so that it can be rotated by the drive motor 5. The drive motor 5 controls the rotation of the print wheel 1 so that the designated type element 4 can be correctly set to the printing position against the platen by operating the hammer 7. When the hammer 7 strikes the back of the type element 4 at the printing position against the platen 6, the type element 4 prints the designated character or symbol onto the print paper 8 set in front of the platen 6 using the ink ribbon 9. Using such a printer, by changing the available printer wheel 1, between italic or Gothic character for example, any type of printing can be optionally achieved.

Now, a wide variety of functions are required for printers. For example, there is a need for printing a simplified diagram, a picture, or a graph together with sentences. It means that there is a strong demand for realizing such a multifunctional printer capable of printing either a picture, a diagram, or a graph together with sentences. Nevertheless, actually, none of the conventional daisy-wheel type printer has ever realized the printing of such a diagram or graph, although the printing by using a variety of character styles can be done very easily.

OBJECT AND SUMMARY OF THE INVENTION

The present invention has made it possible to have the daisy-wheel type printer correctly print any desired picture, diagram, or graph by providing the print wheel with a unique device. The preferred embodiment provides pen(s) for at least one spoke at the position corresponding to the positions of the types at the external circumferential edges of the remaining spokes of the daisy printer wheel. By selecting the spoke provided with pen, any desired diagram or graph can be drawn by using the printer incorporating the preferred embodiments of the present invention, thus resulting in the eventual realization of a multifunctional printer mounting the daisy printer wheel.

DETAILED DESCRIPTION OF THE PREFERRED EMBODIMENTS

Figure 3:
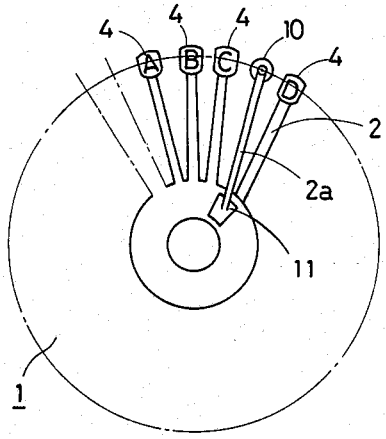
FIG. 3 is the daisy printer wheel incorporating the preferred embodiments of the present invention.
Figure 4:
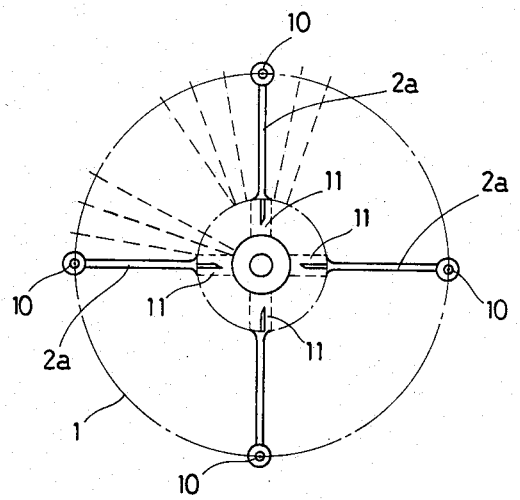
FIG. 4 is the daisy printer wheel incorporating another preferred embodiment.

FIG. 3 shows the configuration of the daisy print wheel reflecting the preferred embodiment of the present invention, and FIG. 4 shows another preferred embodiment, respectively.

Referring now to FIG. 3, the printer wheel 1 has a number of spokes 2,2 . . . and each of these externally extends from the center hub 3, while type elements are provided on the external circumferential edges of these spokes. The spoke 2*a* of the printer wheel 1 is internally provided with an ink passage space, whereas pen 10 is provided on the external circumferential edge that corresponds to the positions of the types on other spokes. Part of the center hub 3 connected to the spoke 2*a* makes up the outlet of the ink pool 11, thus allowing ink to be freely supplied from the ink pool 11 to pen 10 through the ink passage of the spoke 2*a*.

The configuration of the ink pool 11 is described later on.

Figure 1:
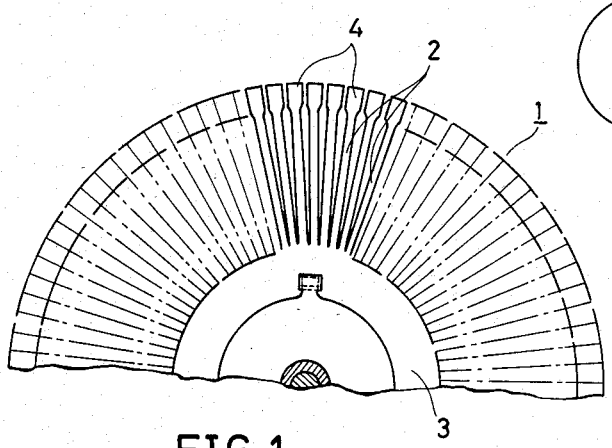
FIG. 1 is a simplified diagram of a conventional printer wheel.
Figure 2:
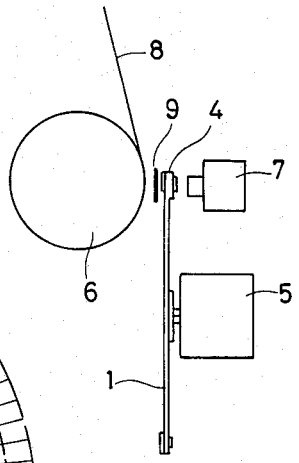
FIG. 2 is a simplified configuration of a printer provided with a printer wheel.
Figure 5:
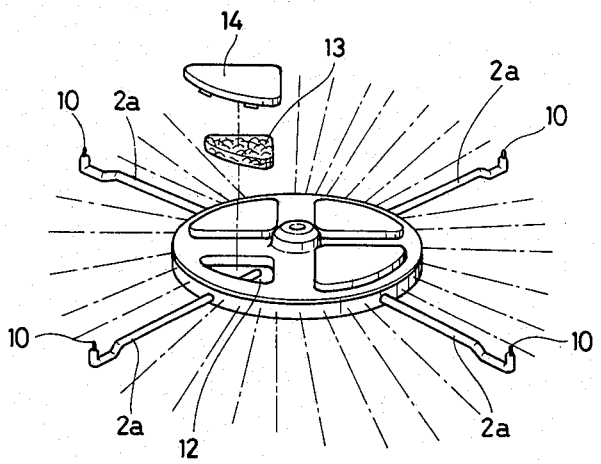
FIG. 5 is a detailed diagram of the daisy printer wheel shown in FIG. 4.
Figure 6:
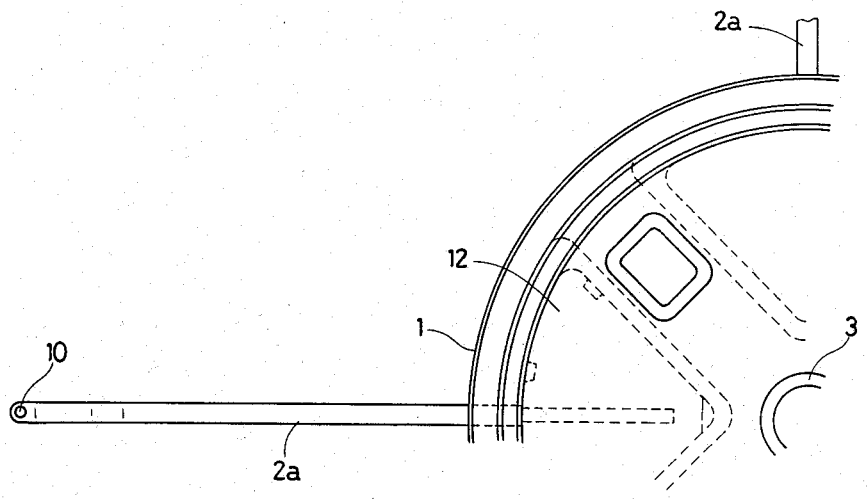
FIG. 6 is a partial plain view of the daisy printer wheel shown in FIG. 4.
Figure 7:
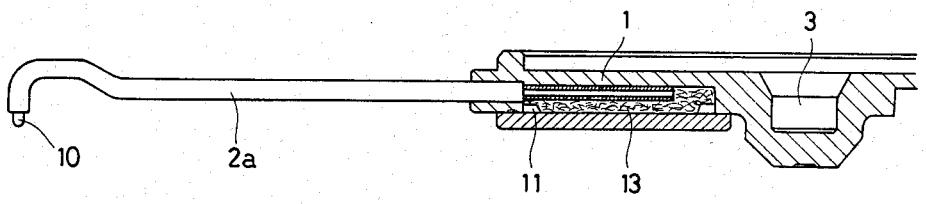
FIG. 7 is a partial sectional view of the daisy printer wheel shown in FIG. 4.

FIG. 4 shows another preferred embodiment of the present invention. There are four pen spokes 2*a* extended from the center hub 3 of the printer wheel 1, whereas all other conventional spokes 2 are provided with type elements 4, respectively. Specifically, the printer wheel 1 shown in FIG. 4 provides 4 units of pen 10, each being set to such a position matching a specific rotational angle of the printer wheel 1. The center hub 3 is provided with an ink pool 11 which is connected to each of the four spokes 2*a* respectively provided with a pen 10, while part of the center hub 3 makes up an outlet connected to the ink pool 11. Each of these spokes 2*a* having a pen 10 can be freely mounted onto or detached from the center hub 3, and yet each of these spokes can be optionally replaced by a conventional spoke 2 provided with a type element. To facilitate the spoke replacement the ink pool 11 provided in the center hub 3 has such a configuration shown in FIG. 5. FIG. 5 shows the details of the printer wheel 1 shown in FIG. 4. As shown in FIG. 5, the center hub 3 containing a coupling unit against the motor shaft in the center position has a substantial thickness. The center hub 3 has four cavities 12 in its circumferential portion each having a specific size, while the ink absorbent member 13 is filled inside each cavity 12. Normally, the cavity 12 is closed by a lid 14 that can be removed when refilling ink. The ink pool 11 is made of these cavities 12, ink absorbent member 13, and the lid 14. Part of the center hub 3 connected to spokes 2*a* each having 1 pen 10 is internally connected to the cavity 12 of the ink pool 11 through the side wall of the cavity 12. This configuration allows ink impregnated in the ink absorbent member 13 of the ink pool 11 to be eventually led to pen 10 from the outlet of the spoke *2a* through the internal ink passage. In FIG. 5, the parts denoted by chain lines between the four spokes *2a* each having a pen 10, respectively indicate conventional spokes 2 having types 4. As described earlier, each of spokes *2a* having a pen 10 can be freely mounted onto or detached from the center hub 3 for replacement with any of the conventional spokes 2 having types 4. Spokes can be replaced very easily without causing ink to flow out of the cavity 12 even when detaching the spoke *2a* from the center hub 3 by being retained by the ink absorbent member 13 filled inside the ink pool 11. The ink pool 11 is closed again by mounting the replaceable spoke 2 that has a conventional type 4. In particular, the preferred embodiment features a capability of performing four-color printing by storing ink having different colors in four ink pools 11. As shown in FIG. 2, the daisy printer wheel 1 incorporating the above preferred embodiments is coupled to the motor shaft mounted on the carriage. When performing a normal printing using types, a designated type element on the printer wheel 1 is set to the printing position where the platen and the print hammer come into contact with each other before the printing is eventually done by the striking hammer. Either the underline or the dotted line can be drawn by first setting any of these pens 10 on the printer wheel 1 to the printing position, followed by properly operating a specific presser separately installed or a by operating hammer to cause pen 10 to be pressed against the print paper 8 so that any desired line can be drawn onto the print paper 8 by transferring the position of the carriage. In this case, such a line can be drawn onto the paper by using any desired color optionally chosen from a plurality of color supplied by a plurality of pens 10. In particular, any kind of picture, diagram, or graph can also be drawn by properly controlling the forwarding operation of the print paper mounted onto the platen relative to the movement of the carriage in the direction of the printable row after setting any of these available pens 10 of the printer wheel 1 to the printing position. As just described above, such a picture, diagram, or a graph can be drawn by using any desired color optionally chosen from a plurality of colors fed to these pens 10. Needless to say that, when any of these pens 10 of the printer wheel has been chosen, the ink ribbon has already been shifted to such a position independent of the printing operation. These preferred embodiments have separately provided pens and the ink pool, however, a still further preferred embodiment integrally provides an ink supply cartridge at the position where the pen 10 is provided.

What is claimed is:

1. A daisy print wheel for use in a rotary wheel impact printer comprising:

a hub;

a plurality of type elements for impressing desired type characters on a desired surface;

a plurality of spokes radially extending from said hub, each said type element being supported at a selected distance from said hub by an associated said spoke;

a pen including means for supplying ink therethrough;

said plurality of spokes including a pen supporting spoke associated with and supporting said pen at said selected distance from said hub, said pen supporting spoke including an ink passage formed therethrough.

2. The daisy print wheel of claim 1 for use in a rotary wheel impact printer including means for generating relative movement between a selected said type element and said desired surface and means for holding said pen against said desired surface;

said pen, when held against said desired surface with relative movement therebetween developing a line in a desired pattern.

3. The daisy print wheel of claim 1 wherein said hub includes an ink reservoir therein which communicates with said ink passage to supply ink to said pen therethrough.

4. The daisy print wheel of claim 3 wherein said ink reservoir includes, a cavity formed in said hub, an ink absorbent member located in said cavity, a cover enclosing said cavity; said pen supporting spoke extending into said cavity.

5. The daisy print wheel of claim 1 wherein a plurality of pens are supported on a plurality of pen supporting spokes, said pen supporting spokes being located equiangularly about said print wheel.

6. The daisy print wheel of claim 1 wherein said pen and associated pen supporting spoke are detachably mounted to said hub to facilitate removal, said pen and pen supporting spoke being replaceable with a said type element and associated said spoke.

7. The daisy print wheel of claim 1 wherein said pen and associated pen supporting spoke are detachably mounted to said hub to facilitate removal, said pen and pen supporting spoke being replaceable with a said type element and associated said spoke.

8. A daisy wheel printer comprising:

means for supporting a desired surface to be printed on;

a carriage mounted for relative two dimensional movement across said desired surface;

a daisy print wheel mounted on said carriage, said daisy print wheel including, a hub, a plurality of type elements for impressing desired type characters on said desired surface, and a plurality of spokes radially extending from said hub, each said type elements being supported at a selected distance from said hub by an associated said spoke;

means for selecting a said type element by rotating said daisy print wheel about its said hub;

a ribbon disposed between the selected said type element and said desired surface;

means for impressing said selected type element against said desired surface through said ribbon;

said daisy print wheel further comprising a pen, said plurality of spokes including a pen supporting spoke associated with and supporting said pen and including an ink passage formed therethrough, said pen being selectable by said means for selecting;

said means for impressing holding said pen directly against said desired surface, when selected by said means for selecting, without said ribbon disposed therebetween.

9. The daisy wheel printer of claim 8 wherein the relative movement of the carriage and said desired surface, when said pen is selected, produces a line of a desired pattern.

10. The daisy print wheel of claim 9 wherein said hub includes an ink reservoir therein which communicates with said ink passage to supply ink to said pen therethrough.

11. The daisy print wheel of claim 10 wherein said ink reservoir includes, a cavity formed in said hub, an ink absorbent member located in said cavity, a cover enclosing said cavity;

said pen supporting spoke extending into said cavity.

12. The daisy print wheel of claim 8 wherein a plurality of pens are supported on a plurality of pen supporting spokes, said pen supporting spokes being located equiangularly about said print wheel.

* * * * *